US009127616B2

(12) United States Patent
Weinenger et al.

(10) Patent No.: US 9,127,616 B2
(45) Date of Patent: Sep. 8, 2015

(54) PISTON ASSEMBLY AND METHOD OF MAKING A PISTON

(71) Applicant: Federal-Mogul Corporation, Southfield, MI (US)

(72) Inventors: Michael Weinenger, Southfield, MI (US); Florin Muscas, Novi, MI (US)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 14/049,622

(22) Filed: Oct. 9, 2013

(65) Prior Publication Data

US 2014/0096735 A1 Apr. 10, 2014

Related U.S. Application Data

(60) Provisional application No. 61/711,414, filed on Oct. 9, 2012.

(51) Int. Cl.
*F02F 3/00* (2006.01)

(52) U.S. Cl.
CPC ..... *F02F 3/003* (2013.01); *F02F 3/0015* (2013.01); *F02F 3/0076* (2013.01); *Y10T 156/10* (2015.01)

(58) Field of Classification Search
CPC ..... F02F 3/0015; F02F 2003/0061; F02F 3/0076; F02F 3/003
See application file for complete search history.

(56) References Cited

U.S. PATENT DOCUMENTS

| | | | | |
|---|---|---|---|---|
| 1,515,077 | A | 11/1924 | Shallenberg | |
| 1,852,105 | A * | 4/1932 | Boyd | 92/141 |
| 2,096,562 | A | 10/1937 | Sarfaty | |
| 2,198,771 | A | 4/1940 | Hazen et al. | |
| 3,789,743 | A | 2/1974 | Sihon | |
| 7,870,669 | B2 * | 1/2011 | Ribeiro et al. | 29/888.05 |
| 2002/0159902 | A1 | 10/2002 | Beaudoin | |
| 2005/0211089 | A1 | 9/2005 | Doers | |
| 2012/0073538 | A1 * | 3/2012 | Hofbauer | 123/197.4 |
| 2013/0118441 | A1 | 5/2013 | Levy et al. | |

* cited by examiner

*Primary Examiner* — Lindsay Low
*Assistant Examiner* — Jacob Amick
(74) *Attorney, Agent, or Firm* — Robert L. Stearns; Dickinson Wright, PLLC

(57) ABSTRACT

An improved piston for an opposed piston internal combustion engine is provided. The piston includes a piston body that extends along an axis from a crown portion to a skirt portion with a full piston skirt and to a pin boss portion. The piston body includes a plurality of ring grooves in the crown portion and at least one ring groove in the skirt portion. A wrist pin which has a length that is longer than a maximum diameter of the piston body is joined with the piston body at the pin boss portion and extends past the pin boss portion for receiving a pair of connecting rods on opposite sides of the piston body. The piston body is a monobloc piston body which is made of one integral piece or of multiple pieces that are welded or adhered together.

16 Claims, 5 Drawing Sheets

PISTON ASSEMBLY AND METHOD OF MAKING A PISTON

CROSS REFERENCE TO RELATED APPLICATION

This application claims the benefit of U.S. Provisional Application Ser. No. 61/711,414, filed Oct. 9, 2012, which is incorporated herein by reference in its entirety.

BACKGROUND OF THE INVENTION

1. Field of the Invention

The present invention is related generally to pistons for internal combustion engines and more particularly to pistons for opposed piston internal combustion engines.

2. Related Art

Typical opposed piston internal combustion engines include an inner piston which has a combustion surface that faces away from the crankshaft and an outer piston which has a combustion surface that faces towards the crankshaft. In operation, both the inner and outer pistons are connected to the same crankshaft and simultaneously transfer power to the crank shaft in response to a fuel and air combustion in a combustion cylinder between the combustion surfaces of the inner and outer pistons. The outer piston typically has a crown portion, a skirt portion and a pin boss portion. A wrist pin is received within the pin boss portion and extends radially outwardly on either side of the piston for receiving a pair of connecting rods to interconnect the outer piston with a crankshaft. Current designs of outer pistons for such opposed piston engines typically include a number of separate pieces, for example, up to eight, which are all joined together through pins, bolts and other removable/non-permanent connections.

SUMMARY OF THE INVENTION

One aspect of the present invention is related to an improved piston for an opposed piston internal combustion engine. The piston includes a piston body which extends along an axis from a crown portion to a skirt portion and to a pin boss portion with the skirt portion being located between the crown and the boss portion. The pin boss portion includes a pair of opposing pin bosses, and the skirt portion includes a full piston skirt. The pin boss body further includes a plurality of ring grooves which substantially circumferentially surround the crown portion and at least one ring groove which substantially circumferentially surrounds the skirt portion. A wrist pin which has a length that is longer than a maximum diameter of the piston body is joined with the pin bosses and extends past each of the pin bosses for receiving a pair of connecting rods. The piston body is a monobloc piston bod made of one integral piece or of multiple pieces which are welded or adhered together. This allows for simpler manufacturing of the piston body and for improved cost effectiveness. Additionally, the full piston skirt provides for improved performance of the piston body in the opposed piston internal combustion engine.

According to another aspect of the present invention, an inner wall of the pin boss portion includes at least one horizontal rib which extends at least partially in a direction that is perpendicular to said axis, and the skirt portion includes at least one vertical rib which extends in a direction that is parallel with the axis. The horizontal and vertical ribs may allow for the other portions of the piston body to be formed with a reduced wall thickness without compromising the structural integrity of the piston body. The reduced wall thicknesses in certain areas of the piston body may provide for material cost savings in addition to improved performance by reducing the total mass or weight of the piston body.

Another aspect of the present invention provides for an improved method of making a piston for an opposed piston internal combustion engine. The method includes the steps of preparing a first piece of a piston body and preparing a second piece of a piston body. The method continues with the step of joining the first and second pieces through one of welding or adhesives to form a monobloc piston body having a crown portion, a skirt portion including a full piston skirt and a pin boss portion including opposing pin bosses. The method proceeds with the step of receiving a wrist pin which has a length that is greater than a maximum diameter of the piston body into the pin bosses of the pin boss portion of the piston body.

According to a further aspect of the present invention, the first piece includes less than the entire crown portion and the second piece includes the remainder of the crown portion, the skirt portion and the pin boss portion.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
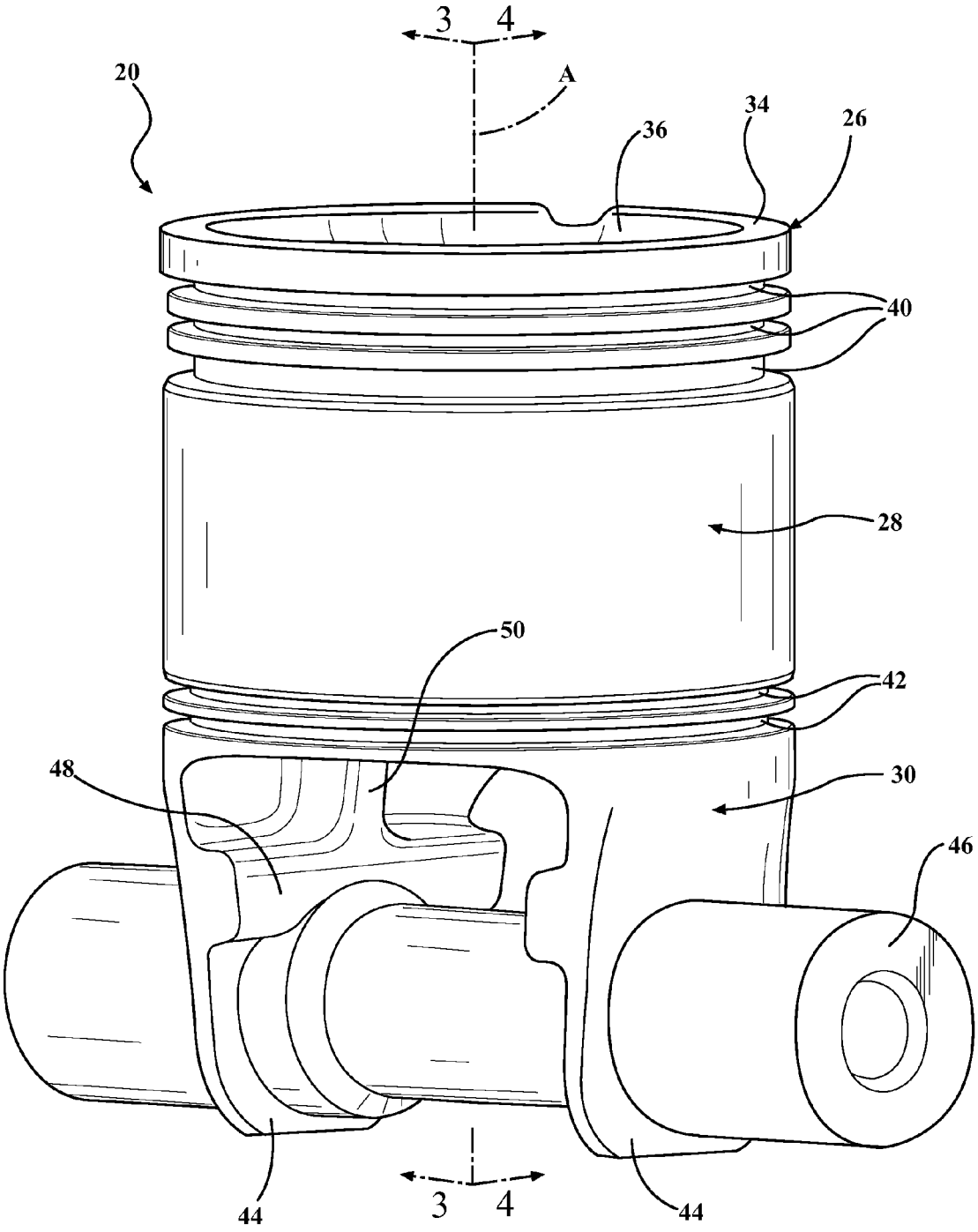
FIG. 1 is a perspective view of an exemplary embodiment of a piston.
Figure 5:
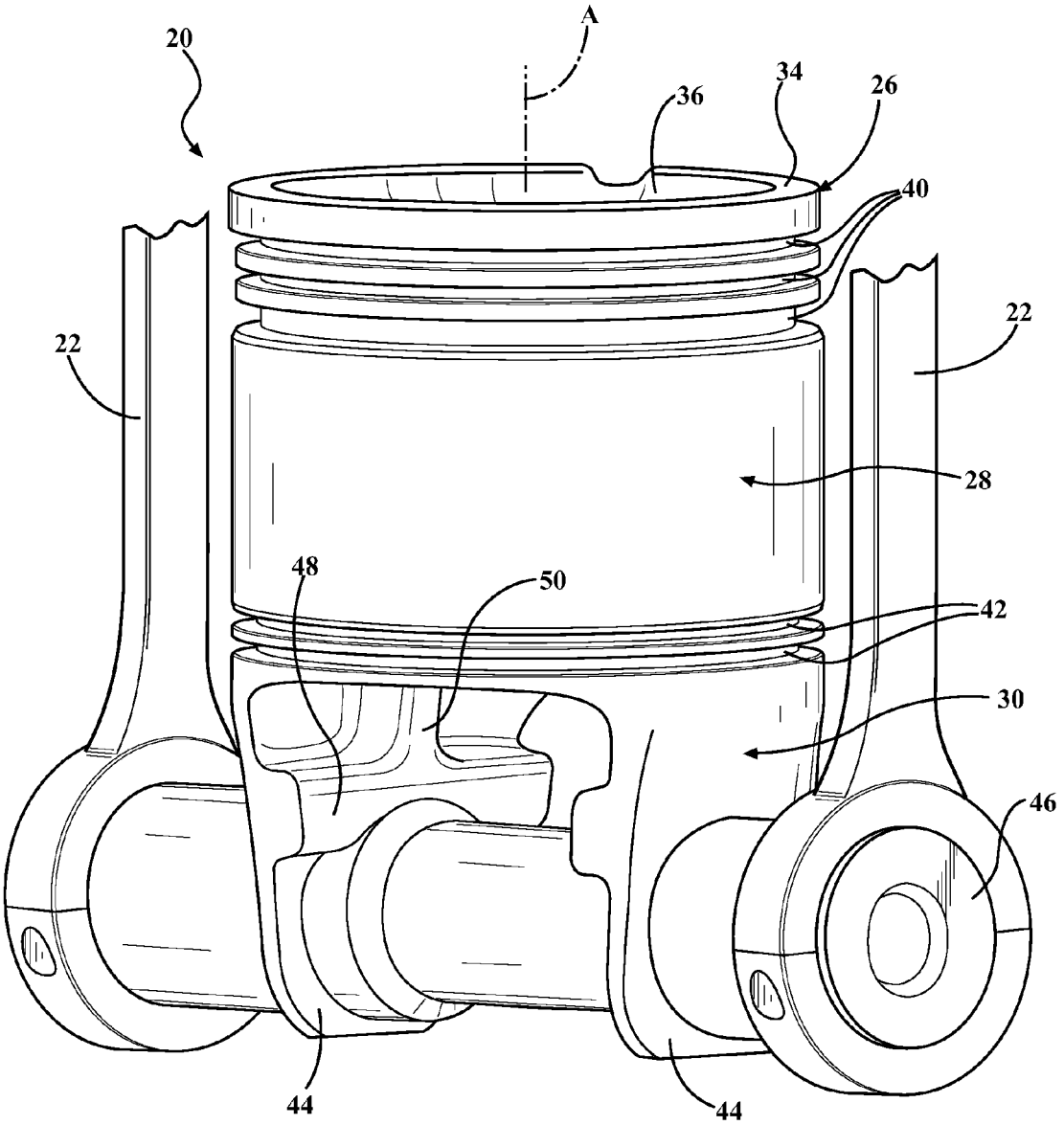
FIG. 5 is a perspective and fragmentary view of the exemplary piston of FIG. 1 in engagement with a pair of connecting rods.

Referring to the Figures, wherein like numerals indicate corresponding parts throughout the several views, an exemplary embodiment of a piston 20 constructed according to one aspect of the present invention is generally shown in FIG. 1. The exemplary piston 20 is configured for use as an outer piston of an opposed piston two-stroke internal combustion engine (not shown) having a single crankshaft. For example, FIG. 5 shows the exemplary piston 20 in engagement with a pair of connecting rods 22 of such a two-stroke internal combustion engine.

Referring back to FIG. 1, the piston 20 of the exemplary embodiment includes a monobloc piston body 24 which extends along an axis A from a crown portion 26 to a skirt portion 28 and then to a pin boss portion 30, i.e., the skirt portion 28 is disposed axially between the crown and pin boss portions 26, 30. The crown portion 26, skirt portion 28 and pin boss portion 30 are all either made of one integral piece or are made of multiple pieces which are welded or adhered together to establish permanent connections between these components.

The crown portion 26 has an upper combustion surface with a generally flat top face 34 and a recessed combustion bowl 36 and an annular ring belt which is configured to receive a plurality of piston rings (not shown) for sealing the piston body 24 with a cylinder wall (not shown). In the exemplary embodiment, the ring belt 38 includes three axially spaced ring grooves 40 (hereinafter referred to as "upper ring grooves 40") which are configured to receive a pair of compression rings for sealing combustion gasses in a combustion chamber above the piston body 24 and an oil control ring for scraping oil off of the cylinder wall. It should be appreciated that the ring belt may include any suitable number of ring grooves for receiving any suitable number of piston rings.

Figure 3:
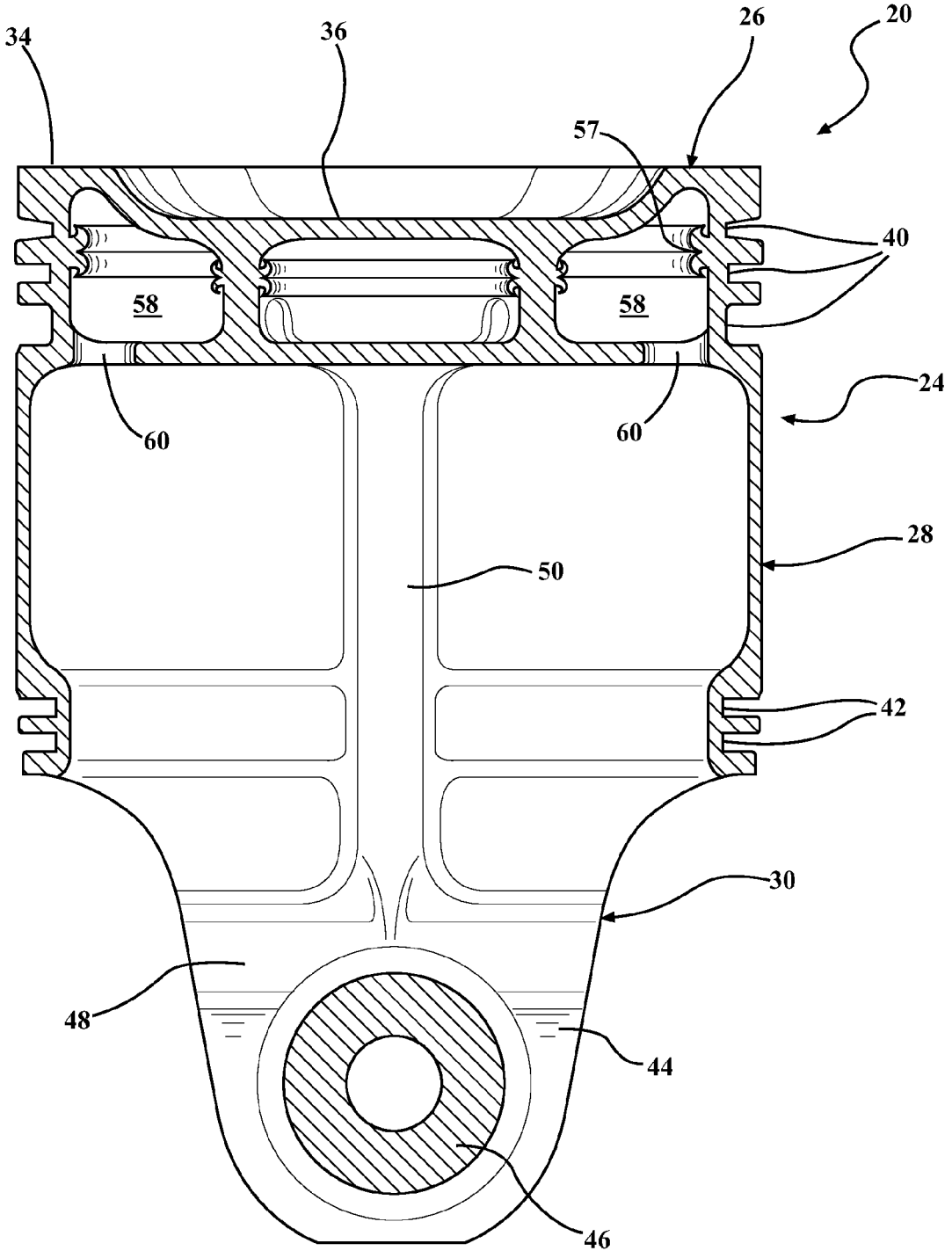
FIG. 3 is a cross-sectional view of the exemplary piston of FIG. 1 taken along line 3-3 of FIG. 1.

Because the pin boss portion 30 is axially below, as opposed to axially aligned with, the skirt portion 28, the skirt portion 28 of the piston body 24 is a full piston skirt in that it includes a generally flat outer surface which extends uninterruptedly substantially continuously around the piston body 24, i.e. through 360 degrees around the axis A. This provides the skirt portion 28 of the piston body 24 with improved performance as compared to non-continuous skirts of other known pistons. Adjacent the flat, uninterrupted outer surface, the skirt portion 28 includes a pair of ring grooves 42 (hereinafter referred to as "lower ring grooves 42") which are spaced axially from the upper ring grooves 40 in the crown portion 26 and are located adjacent the pin boss portion 30 of the piston body 24. In the exemplary embodiment, the skirt portion 28 has two lower ring grooves 42. However, it should be appreciated that any suitable number of lower ring grooves 42 may be provided. The piston rings in between the upper ring grooves 40 on the crown portion 26 and the piston rings in the lower ring grooves 42 on the skirt portion 28 together restrict the passage of air and fuel from one or more intakes on the cylinder wall from leaking past the piston body 24 in either axial direction during operation of an opposed piston 20 two-stroke internal combustion engine. As best shown in FIG. 3, in the exemplary embodiment, the inner wall of the skirt portion 28 is recessed in the area of the lower ring grooves 42 to allow for a reduced wall thickness in the area of the generally flat outer wall of the skirt portion 28.

Figure 4:
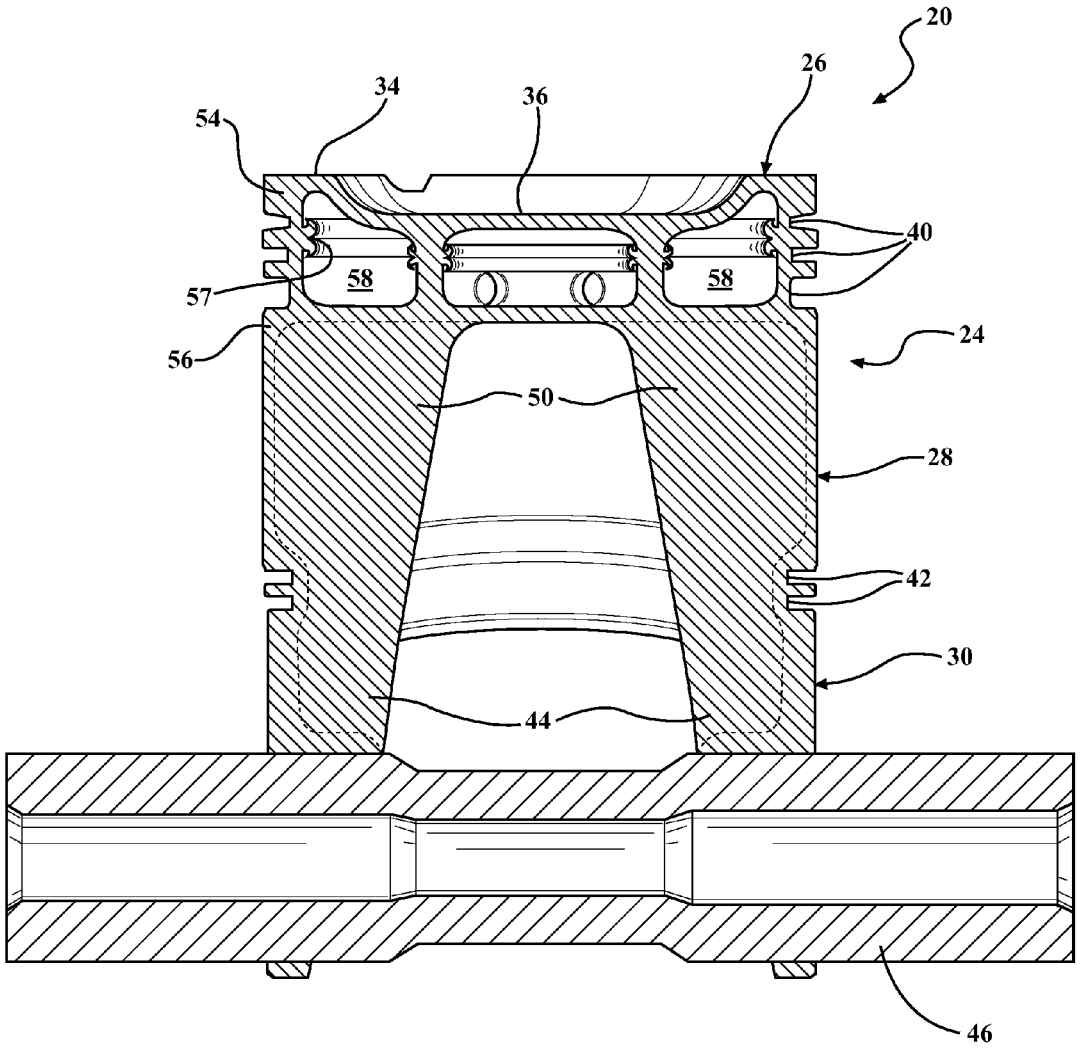
FIG. 4 is a cross-sectional view of the exemplary piston of FIG. 1 taken along line 4-4 of FIG. 1.

Referring now to FIG. 4, the pin boss portion 30 of the piston body 24 includes a pair of pin bosses 44 which are aligned with one another and are spaced from one another by a distance which, in the exemplary embodiment, corresponds approximately with the maximum diameter of the piston body 24. Each of the pin bosses 44 has an opening, and a wrist pin 46 (also known as a gudgeon pin) extends through the aligned openings and is joined with the pin bosses 44. The wrist pin 46 has a length which is greater than the maximum diameter of the piston body 24, and the ends of the wrist pin 46 project outwardly from the pin bosses 44 for engaging connecting rods 22 on opposite sides of the piston body 24 as is shown in FIG. 6. The wrist pin 46 may be connected with the pin bosses 44 of the piston body 24 through any suitable process or means including, for example, welding, brazing, mechanical fasteners, etc. As best shown in FIG. 3, in the exemplary embodiment, the wrist pin 46 is hollow for mass savings purposes.

Figure 2:
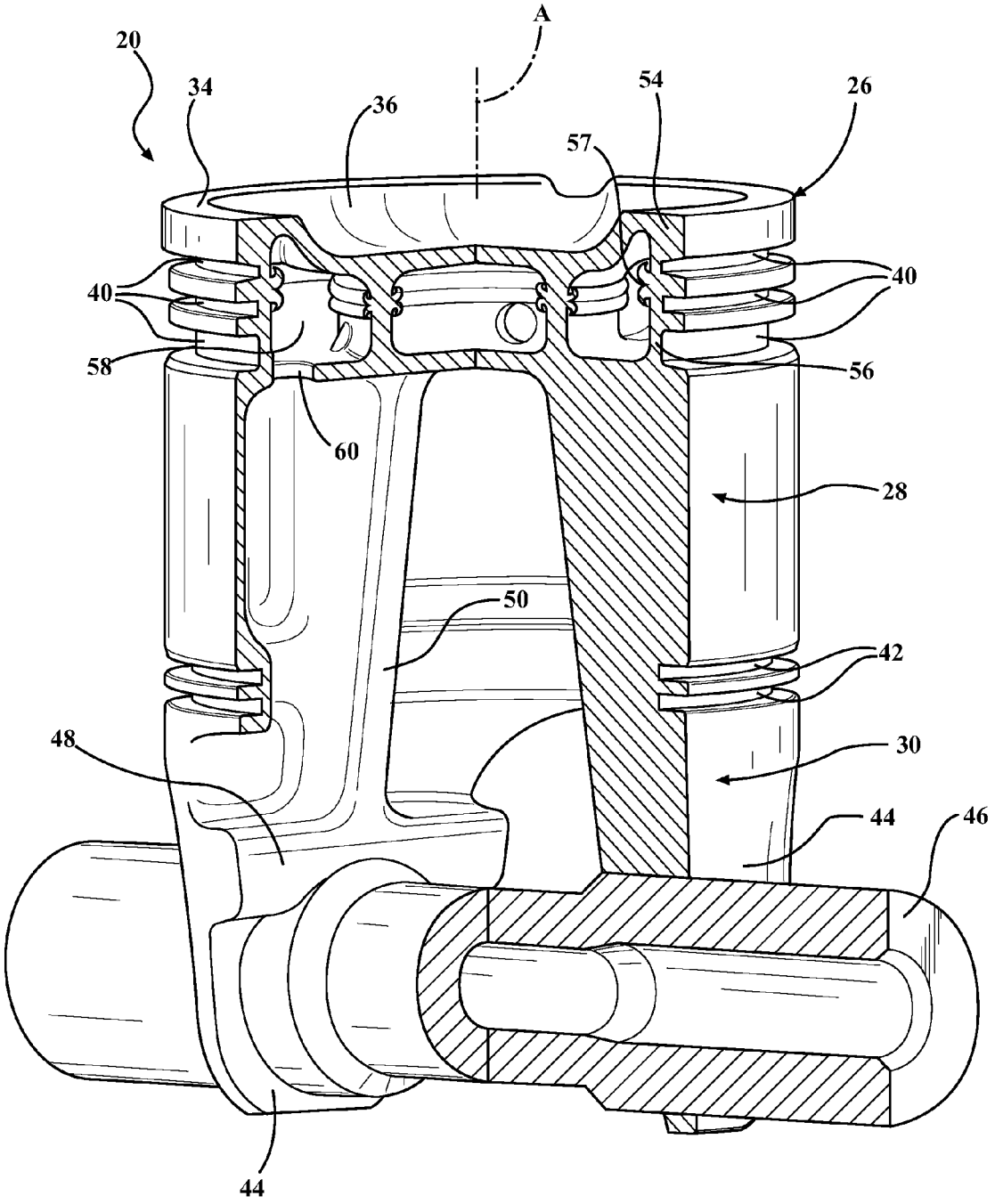
FIG. 2 is a perspective and partially sectional view of the piston of FIG. 1.

As best shown in FIGS. 2 and 3, the inner walls of the pin bosses 44 have horizontally (or circumferentially) extending ribs 48 which provide structural reinforcement to the pin boss portion 30 of the piston body 24. The skirt portion 28 also includes vertically (or axially) extending ribs 50 which depend from the crown portion 26 and extend from the crown portion 26 to the horizontal ribs 48 on the pin boss portion 30. The horizontal and vertical ribs 48, 50 may allow for the other portions of the piston body 24 to be formed with a reduced wall thickness without compromising the structural integrity of the piston body 24. The reduced wall thicknesses in certain areas of the piston body 24 may provide for material cost savings in addition to improved performance by reducing the total mass or weight of the piston body 24.

Referring back to FIG. 3, the monobloc piston body 24 of the exemplary embodiment is made of two separate pieces 54, 56 (hereinafter referred to as an "upper piece 54" and a "lower piece 56" which are formed separately and are subsequently joined together. For example, in the exemplary embodiment, the upper and lower pieces 54, 56 are joined together at a weld seam 57. The upper and lower pieces 54, 56 are preferably formed of the same material (such as steel or aluminum, for example) and are individually shaped, for example, through casting, forging and/or machining processes. The upper and lower pieces 54, 56 are then preferably joined together through a friction welding operation. However, it should be appreciated that the upper and lower pieces 54, 56 could alternately be formed of different materials and they could be joined together through any suitable process including, for example, other types of induction welding, resistance welding, brazing, soldering, laser welding, charge carrier rays, gluing, screwing, bolting, synching, mechanical deformation, etc. The piston body 24 may require additional machining after the upper and lower pieces 54, 65 are joined together.

As best shown in FIG. 3, in the exemplary embodiment, the weld seam where the upper and lower pieces 54, 56 are joined together is located within the crown portion 26 of the piston body 24. As such, some of the crown portion 26 is presented by the upper piece 54, and some of the crown portion 26 is presented by the lower piece 56. The upper and lower pieces 54, 56 are each shaped such that joining them together results in the formation of an oil gallery 58 below the combustion surface 32 of the crown portion 26, i.e., the oil gallery 58 is presented at least partially by each of the upper and lower pieces 54, 56. The lower piece 56 is provided with ports 60 for allowing a cooling oil (not shown) to enter and exit the oil gallery 58, thereby allowing the cooling oil to extract heat from the crown portion 26 of the piston body 24 during operation of the engine. The ports 60 may be formed into the lower piece 56 either during the initial formation of the lower piece 56 or after the upper and lower pieces 54, 56 have been joined together. It should be appreciated that the upper and lower pieces 54, 56 or the entire piston body 24 could also be made through an additive manufacturing technique, such as 3*d* printing or sintering.

The piston body 24 is either made of one integral piece of material or is made of multiple pieces (preferably two or fewer pieces) which are welded or adhered together. This allows the piston body 24 to be manufactured more efficiently and at a lower cost than other known piston bodies for opposed piston two-stroke internal combustion engines because it lacks the bolts, pins and other mechanical fasteners that join the various components of other piston bodies together. Additionally, the overall structure of the piston body 24 is more rigid and less likely to rock while oscillating during operation of the engine which reduces skirt scuffing. Even further, the horizontal and vertical ribs 48, 50 and the recessed inner wall of the skirt portion 28 allow for material savings and weight reduction advantages.

Another aspect of the present invention provides for a method of making a piston 20 for an opposed piston internal combustion engine. The exemplary method includes the step of preparing a first (or upper) piece 54 of a piston body including less than an entire crown portion 26. The method continues with the step of preparing a second (or lower) piece 56 of a piston body 24 including less than an entire crown portion 26. The second piece 54 also includes a skirt portion which includes a generally flat outer surface that extends uninterruptedly substantially continuously around the second piece 54 and a pin boss portion 30 which includes a pair of opposing pin bosses 44. The second piece 56 is preferably formed with a horizontal rib 48 in the pin boss portion 30 and a vertical rib 50 in the skirt portion 28.

The first and second pieces 54, 56 may be made of any suitable metal including, for example, aluminum or steel and may be shaped through any suitable process or combination of processes including, for example, casting, forging and/or machining. The exemplary method continues with the step of joining the first and second pieces 54, 56 together through at least one of welding and adhesives to form a monobloc piston body 24.

The exemplary method proceeds with the step of joining a wrist pin 46 which has a length that is greater than a maximum diameter of the first and second pieces 54, 56 with the pin bosses 44 in the pin boss portion 30 of the piston body 24. The wrist pin 46 is preferably joined with the pin boss portion 30 through a welding process.

Obviously, many modifications and variations of the present invention are possible in light of the above teachings and may be practiced otherwise than as specifically described while within the scope of the appended claims.

What is claimed is:

1. A piston for an opposed piston internal combustion engine, comprising:

a piston body that extends along an axis and includes a crown and a skirt which depends from said crown and a pair of aligned pin bosses which depend from said skirt on an axial side of said skirt opposite of said crown, and at least a portion of said skirt being a full piston skirt with a flat surface which extends uninterruptedly around said piston body;

said piston body including a plurality of ring grooves surrounding said crown and at least one additional ring groove which is spaced from said crown by at least a portion of said skirt;

a wrist pin having a length that is longer than a maximum diameter of said piston body, said wrist pin being received within said pin bosses and extending past each of said pin bosses for receiving a pair of connecting rods; and wherein said piston body is a monobloc piston body made of one integral piece or of multiple pieces welded or adhered together.

2. The piston as set forth in claim 1 wherein said piston body is made of no more than two pieces.

3. The piston as set forth in claim 1 wherein said piston body further includes at least one vertical rib which extends in a direction parallel to said axis from said crown to at least one of said pin bosses for structurally reinforcing said piston body.

4. The piston as set forth in claim 1 wherein an inner wall of at least one of said pin bosses includes at least one horizontal rib which extends at least partially in a direction that is perpendicular to said axis for providing structural reinforcement to said at least one pin boss.

5. The piston as set forth in claim 4 wherein an inner wall of said skirt includes at least one vertical rib which extends in a direction that is parallel to said axis for providing further structural reinforcement to at least one of said pin bosses.

6. The piston as set forth in claim 5 wherein said at least one vertical rib depends from said crown extends axially to said at least one horizontal rib.

7. The piston as set forth in claim 1 wherein said wrist pin is welded to said pin bosses.

8. The piston as set forth in claim 1 wherein said piston body is formed of two pieces which are joined together at said crown and wherein said piston body includes an oil gallery which is presented at least partially by each of said two pieces.

9. A method of making a piston for an opposed piston internal combustion engine, comprising:

preparing a first piece of a piston body;

preparing a second piece of a piston body;

joining said first and second pieces together through at least one of welding and adhesives to form a monobloc piston body having a crown, a skirt which is at least partially a full piston skirt with a flat surface which extends uninterruptedly around the piston body, and a pair of opposing pin bosses, said piston body including a plurality of ring grooves surrounding said crown and at least one additional ring groove which is spaced from said crown by at least a portion of said skirt; and receiving a wrist pin which has a length that is greater than a maximum diameter of the piston body into the pin bosses of the piston body.

10. The method as set forth in claim 9 wherein said first piece includes less than the entire crown and wherein said second piece includes the remainder of the crown, the skirt and the pin bosses.

11. The method as set forth in claim 10 wherein joining the first and second pieces provides the piston body with an oil gallery in the crown.

12. The method as set forth in claim 9 wherein the step of joining the first and second pieces together is further defined as welding the first and second pieces together.

13. The method as set forth in claim 12 wherein the step of welding the first and second pieces together is further defined as friction welding the first and second pieces together.

14. The method as set forth in claim 13 wherein at least one of the pin bosses of the piston body includes a horizontal rib.

15. The method as set forth in claim 14 wherein the skirt of the piston body includes a vertical rib for structurally reinforcing the piston body.

16. The method as set forth in claim 15 wherein the vertical rib depends from the crown and extends to the horizontal rib for structurally reinforcing the piston body.

* * * * *